US011821136B2

(12) United States Patent
Regier et al.

(10) Patent No.: US 11,821,136 B2
(45) Date of Patent: Nov. 21, 2023

(54) METHOD AND DEVICE FOR FEEDING ITEMS OF LAUNDRY TO A LAUNDRY TREATMENT APPARATUS, PREFERABLY A MANGLE

(71) Applicant: Herbert Kannegiesser GmbH, Vlotho (DE)

(72) Inventors: Eduard Regier, Leopoldshöhe (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 0 days.

(21) Appl. No.: 17/737,357

(22) Filed: May 5, 2022

(65) Prior Publication Data

US 2022/0380970 A1 Dec. 1, 2022

(30) Foreign Application Priority Data

Jun. 1, 2021 (DE) ..... 102021114236.9

(51) Int. Cl.
*D06F 67/04* (2006.01)

(52) U.S. Cl.
CPC ..... *D06F 67/04* (2013.01)

(58) Field of Classification Search
CPC ..... D06F 67/04; D06F 71/38; B65G 47/02; B65G 47/22
See application file for complete search history.

(56) References Cited

U.S. PATENT DOCUMENTS 2,624,138 A * 1/1953 Taylor ..... D06F 67/04 38/143
3,431,665 A * 3/1969 Weir ..... D06C 3/00 38/143
3,736,678 A * 6/1973 Kamberg ..... D06F 67/04 38/143
4,093,205 A * 6/1978 Kober ..... B65H 45/04 493/425
5,416,992 A * 5/1995 Ueda ..... D06F 67/04 198/689.1
5,437,114 A * 8/1995 Kuipers ..... D06F 67/04 38/143
5,515,627 A * 5/1996 McCabe ..... D06F 67/04 38/143
5,606,811 A * 3/1997 Jensen ..... D06F 67/04 38/143

* cited by examiner

*Primary Examiner* — Ismael Izaguirre
(74) *Attorney, Agent, or Firm* — Laurence P. Colton; SMITH TEMPEL BLAHA LLC

(57) ABSTRACT

Laundry items are spread out by input machines having loading stations with a belt conveyor. The laundry item is placed on a front region of the belt conveyor and pulled further onto the belt conveyor. It is necessary to smooth the laundry item upstream of the belt conveyor using a smoothing machine, which can hinder the pulling of the laundry item onto the belt conveyor. The invention provides a pivotable smoothing means which is in an inactive position for initially pulling the laundry item onto the belt conveyor and is pivoted into an active position only after the laundry item has been initially pulled onto the lower belt conveyor. The laundry item is placed on the smoothing means only after it has been initially pulled onto the lower belt conveyor. Thus, when the laundry item is initially pulled onto the lower belt conveyor, it is prevented from slipping down therefrom.

16 Claims, 6 Drawing Sheets

METHOD AND DEVICE FOR FEEDING ITEMS OF LAUNDRY TO A LAUNDRY TREATMENT APPARATUS, PREFERABLY A MANGLE

CROSS REFERENCE TO RELATED APPLICATIONS

This patent application claims the benefit of and priority on German Patent Application No. 10 2021 114 236.9 having a filing date of 1 Jun. 2021.

BACKGROUND OF THE INVENTION

Technical Field

The invention relates to a method for feeding items of laundry to a laundry treatment apparatus, preferably a mangle, wherein one respective item of laundry is transferred to a belt conveyor of at least one loading station and a smoothing means for smoothing the item of laundry is arranged upstream of the belt conveyor, the item of laundry is transferred from the at least one loading station onto a spreading apparatus, from which the item of laundry is spread out transversely to the feed direction in which the item of laundry is able to be fed to the laundry treatment apparatus, and the spread-out item of laundry is fed at least by at least one feed conveyor to the laundry treatment apparatus. The invention further relates to a device for feeding items of laundry to a laundry treatment apparatus, preferably a mangle, with at least one loading station which has at least one belt conveyor transporting one respective item of laundry in the feed direction, and a smoothing means is arranged on the starting portion thereof, with a spreading apparatus which is arranged downstream in the feed direction of the at least one loading station for spreading out the item of laundry transversely to the feed direction, and with at least one feed conveyor for feeding the spread-out item of laundry to the laundry treatment apparatus.

Prior Art

In industrial laundries, items of laundry are fed to laundry treatment apparatuses, for example mangles, with devices which are denoted in technical jargon as "input machines". The items of laundry are fed to the laundry treatment apparatuses in the feed direction. In this case, the transverse edges of the items of laundry run transversely to the feed direction and the longitudinal edges run in the feed direction.

Known devices for feeding items of laundry to a laundry treatment apparatus, such as for example a mangle, have one or more loading stations with at least one narrow lower belt conveyor, a spreading device with at least one spreading clamp pair and at least one feed conveyor and optionally a depositing strip. A front part of a narrow longitudinal strip of the item of laundry located between the longitudinal edges is manually or automatically deposited on a front exposed depositing region of the lower belt conveyor. The belt conveyor transports the item of laundry in the direction of the spreading apparatus, wherein the longitudinal strip moves across the belt conveyor of the respective loading station. The item of laundry is spread out in the spreading apparatus and the spread-out item of laundry is then deposited by the spreading apparatus onto the starting portion of the at least one feed conveyor or a depositing strip assigned thereto. Subsequently the spread-out item of laundry is transported from the at least one feed conveyor to the laundry treatment apparatus, for example a mangle, and introduced therein.

In the above-described, known device a smoothing means is provided in a stationary manner upstream of the starting portion of the at least one lower belt conveyor of the respective loading station. As a result, the part of the item of laundry still located upstream of the belt conveyor is smoothed at the side, so that when pulled onto the loading conveyor the item of laundry slips over the smoothing means and as a result hangs with the longitudinal strips located on the lower belt conveyor in a U-shaped configuration over the loading conveyor. It has been shown that primarily with heavy and/or large items of laundry the smoothing means generates a large retaining force, whereby after placing a front part of the longitudinal strip of the item of laundry onto a front depositing region of the lower belt conveyor, the frictional force is insufficient between the part of the longitudinal strip located on the depositing region and the belt conveyor. The item of laundry is then not able to be pulled onto the belt conveyor and in some cases even slips down from the belt conveyor, counter to the feed direction. This results in disruptions to the operation.

BRIEF SUMMARY OF THE INVENTION

The object of the invention, therefore, is to provide a method and a device for feeding items of laundry to a laundry treatment apparatus, in particular a mangle, which ensure that the items of laundry are pulled in a reliable manner onto a lower belt conveyor of the respective loading station.

A method for achieving this object comprises a method for feeding items of laundry to a mangle or another laundry treatment apparatus, wherein one respective item of laundry is transferred to a belt conveyor of at least one loading station and a smoothing means for smoothing the item of laundry is arranged upstream of the belt conveyor, the item of laundry is transferred from the at least one loading station onto a spreading apparatus, from which the item of laundry is spread out transversely to the feed direction in which the item of laundry is able to be fed to the laundry treatment apparatus, and the spread-out item of laundry is fed at least by at least one feed conveyor to the laundry treatment apparatus, wherein the smoothing means is brought from an inactive position into an active position after the item of laundry has been initially pulled onto the belt conveyor in the feed direction, wherein in the active position the smoothing means is supported below the item of laundry for smoothing the part of the item of laundry, which is still located upstream of the belt conveyor, when pulled further onto the belt conveyor. In this method it is provided to bring the smoothing means assigned to the loading station or the respective loading station from an initial inactive position into an active position only after the item of laundry has been initially pulled onto the lower belt conveyor in the feed direction. Then the smoothing means in the active position serves for smoothing the part of the item of laundry which is still hanging down upstream of the belt conveyor, when it is pulled further onto the lower belt conveyor. In the inactive position, however, the part of the item of laundry hanging down upstream of the lower belt conveyor is not yet located on the respective smoothing means. As a result, when the item of laundry is initially pulled onto the lower belt conveyor, the smoothing means does not yet exert a force oriented counter to the feed direction, as a result of the friction between the smoothing means and the item of laundry. As a result, the inactive smoothing means does not prevent or hinder the item of laundry being initially pulled onto the lower belt conveyor of the respective loading station.

It is preferably provided to place and/or to deposit the respective item of laundry onto a depositing region on the starting portion of the lower belt conveyor, preferably an upper run, when the smoothing means is in the inactive position. If the upper run of the driven belt conveyor is now advanced in the feed direction by the driven belt conveyor, the front part of the longitudinal strip of the item of laundry, hitherto being supported only on the placement region, is reliably entrained by frictional contact and as a result the item of laundry is pulled further onto the lower belt conveyor since the still inactive smoothing means at this time does not yet exert a frictional force on the item of laundry acting counter to the feed direction.

The method may be advantageously developed such that, when the smoothing means is still located in the inactive position, the respective item of laundry is placed or deposited onto the placement region of the belt conveyor with a starting portion of the longitudinal strip extending from a front transverse edge running transversely to the feed direction. Thus, the starting portion of the longitudinal strip of the respective item of laundry initially only comes into contact with the lower belt conveyor, namely the placement region thereof. Then the front part of the longitudinal strip of the item of laundry has a relatively low frictional contact with the part of the upper run of the lower belt conveyor located in the placement region. This frictional contact is sufficient in order to pull the item of laundry initially onto the lower belt conveyor, uninfluenced by the smoothing means located in the inactive position, and namely sufficiently far until the frictional contact with the upper run of the lower belt conveyor is sufficiently increased that the smoothing means is able to be brought into its active position, without the risk still being present of the item of laundry slipping down counter to the feed direction from the lower belt conveyor or the item of laundry not being pulled further onto the lower belt conveyor.

A further advantageous embodiment of the method provides to pivot the smoothing means of the loading station or the respective loading station from an active position into an inactive position and vice-versa. By such a pivoting, the respective smoothing means may be transferred in a particularly simple manner from the active into an inactive position (and vice-versa). In this case, the smoothing means may adopt an inactive position which deviates significantly from the active position.

By pivoting this smoothing means, it is possible to bring an upper edge and/or an upper sliding surface of the smoothing means, onto which the item of laundry is positioned and/or slides along when the smoothing means is inactive, into such a position upstream of the lower belt conveyor, in particular the placement region thereof, in which the item of laundry is effectively smoothed by the friction between the item of laundry and the upper edge and/or the upper sliding surface of the respective smoothing means, and namely such that edge portions of the item of laundry adjoining the longitudinal strips on either side hang down on either side adjacent to the narrow lower belt conveyor and adopt a U-shaped configuration. In this case only the narrow longitudinal strip between the edge portions is positioned on the upper run of the narrow lower belt conveyor. However, by pivoting the smoothing means into the inactive position, in which the free end of the smoothing means oriented away from the belt conveyor is preferably pivoted down, the upper edge and/or the upper sliding surface of the smoothing means may be brought out of contact with the item of laundry. In particular, it is thus ensured that when an item of laundry starts to be pulled onto the belt conveyor, the larger part of the item of laundry which is still located upstream thereof is not positioned on the smoothing means. Preferably, the smoothing means is able to be pivoted sufficiently far into the inactive position that the part of the item of laundry which is still located upstream of the lower belt conveyor does not come into contact with at least the upper edge and/or the upper sliding surface of the smoothing means, preferably the entire smoothing means. As a result, it is ensured that after the front part of the longitudinal strip of the item of laundry has been placed onto the depositing region of the lower belt conveyor, the item of laundry does not slip down therefrom and may be initially pulled onto the belt conveyor.

Optionally the method is developed such that each loading station not only has a lower belt conveyor, the front region thereof of the upper run forming the depositing region for the item of laundry to be fed, but also a second upper belt conveyor. The second upper belt conveyor is assigned to the first lower belt conveyor such that it only partially overlaps this first lower belt conveyor, by the upper run of the lower belt conveyor and a lower run of the upper belt conveyor being oriented toward one another, preferably being superimposed in a sandwich-like manner, and also being able to be in contact with one another when an item of laundry is currently not located between the two belt conveyors. Preferably, the upper belt conveyor is configured to be shorter than the lower belt conveyor, wherein the starting portion of the upper belt conveyor is set back relative to the starting portion of the lower belt conveyor in the feed direction and namely preferably sufficiently far that the upper belt conveyor exposes the depositing region of the item of laundry on the upper run of the lower belt conveyor. Thus, a front part of the longitudinal strip of the item of laundry may be placed onto the depositing region of the lower belt conveyor without the upper belt conveyor interfering therewith. After the item of laundry, in particular the longitudinal strip thereof, has been initially pulled onto the lower belt conveyor, starting with an internal portion of the front transverse edge which is located in the region of the longitudinal strip, the item of laundry then passes into a gap between the superimposed belt conveyors. As a result, these belt conveyors exert a sufficient pulling force on the front region of the longitudinal strip of the item of laundry in order to pull the part of the item of laundry still located upstream of the lower belt conveyor over the smoothing means which has then been brought into the active position, whereby when the item of laundry has been transported further in the feed direction this item of laundry is effectively smoothed upstream of at least the lower belt conveyor, which ensures that the item of laundry is transported further to the spreading apparatus in a manner which is uninterrupted and crease-free.

After an item of laundry has passed the starting portion of the lower belt conveyor and the upper belt conveyor of the respective loading station optionally assigned thereto, the smoothing means of this loading station is again pivoted back into the inactive position below the lower belt conveyor so that it does not hinder the initial pulling of the next item of laundry onto the lower belt conveyor.

A device for achieving the object mentioned in the introduction comprises a device for feeding items of laundry to a mangle or another laundry treatment apparatus with at least one loading station which has at least one belt conveyor transporting one respective item of laundry in the feed direction, and a smoothing means is arranged on the starting portion thereof, with a spreading apparatus which is arranged downstream in the feed direction of the at least one loading station for spreading out the item of laundry transversely to the feed direction, and with at least one feed conveyor for feeding the spread-out item of laundry to the laundry treatment apparatus, wherein the smoothing means of the at least one loading station is able to be brought from an inactive position into an active position and vice-versa. Accordingly, the respective smoothing means is able to be brought from an inactive position into an active position and vice-versa. In the inactive position the smoothing means does not influence and/or impede the initial pulling of the item of laundry onto the lower belt conveyor of the respective loading station. Only in the active position does the smoothing means thereby exert a plow-like action on the lower part, preferably central part, of the item of laundry which is still located upstream of the depositing region of the lower belt conveyor. This leads to the effective smoothing of the part of the item of laundry which is still located upstream of the lower belt conveyor and/or to the pulling of the item of laundry in a manner which is crease-free and preferably also taut, in particular of the longitudinal strip of the item of laundry located between the outer longitudinal edges thereof, onto the lower belt conveyor. However, the pulling means assists this smoothing of the item of laundry only when the item of laundry is already sufficiently pulled onto the lower belt conveyor. Only then is the smoothing means located in its active position, which results in the item of laundry no longer being able to slip down from the placement region and/or the item of laundry being able to be reliably transported further in the feed direction by the belt conveyor.

Preferably, it is provided to arrange the respective smoothing means pivotably at an initial end or end region of the lower belt conveyor of the respective loading station, when viewed in the feed direction. In particular, the respective smoothing means is pivotable by means of at least one drive, for example a pneumatic cylinder. As a result, the smoothing means may be pivoted down into the inactive position so that in this manner it passes out of the region for pulling in the item of laundry. In order to transfer the smoothing means into the active position, it is pivoted up so that the item of laundry is positioned thereon or is able to be pulled across said smoothing means when pulled onto the lower belt conveyor, and at least at the same time the smoothing is carried out of the part of the item of laundry still located upstream of the lower belt conveyor.

It is preferably provided to pivot the smoothing means about a horizontal pivot axis which runs transversely to the feed direction, in order to bring it from the active position into the inactive position and vice-versa. As a result, by the pivoting-up action the smoothing means may be brought into the active position upstream of the placement region of the lower belt conveyor, whilst by the pivoting-down action the smoothing means is able to be brought into the inactive position in which it adopts a resting position below the front part of the lower belt conveyor.

It may also be provided to pivot the at least one smoothing means up into the active position and down into the inactive position by pivoting by a pivoting angle of 70° to 110°. Preferably, the pivot angle is approximately 90°, wherein it may be greater than or less than this by up to 10°.

According to an advantageous embodiment of the device it is provided to configure the or each smoothing means in a C-shaped or horseshoe-shaped manner. As a result, in the active position of the smoothing means, a part of the item of laundry located thereabove may be supported on the upper edge of the smoothing means which is configured in a C-shaped manner or the surface of the smoothing means which is configured in a horseshoe-shaped manner. Preferably, the respective smoothing means is movably mounted, in particular pivotably mounted, with its parallel limbs on opposing sides of a stationary support frame of the respective lower belt conveyor. Such a smoothing means may be of simple configuration and may be brought from the active into the inactive position in a simple manner.

The respective smoothing means may be designed in various ways, preferably it has a large U-shaped, omega-shaped or horseshoe-shaped design. In the simplest case, such a smoothing means may be formed from a curved metal strip. By the aforementioned configuration, the smoothing means contributes to the effective smoothing of the part of the item of laundry still located upstream of the lower belt conveyor, in particular transversely to the feed direction. The effective smoothing of the item of laundry is preferably also assisted by the part of the item of laundry, which is currently located in the region of the smoothing means located in the active position, being supported on the upper edge of the smoothing means which is configured in a C-shaped manner or the upper surface of the smoothing means which is configured in a horseshoe-shaped manner and being able to slide along said smoothing means.

In an advantageously designed device, it is provided that the lower belt conveyor has a width which is less than the width of the item of laundry to be fed to the laundry treatment apparatus. This width corresponds approximately to the width of the longitudinal strip of the respective item of laundry between two opposing longitudinal edges. As a result, the outer free edge portions adjoining the longitudinal strips on either side of the narrow lower belt conveyor hang down on opposing sides from the upper run of the lower belt conveyor so that the item of laundry is able to be pulled in a U-shaped configuration onto the lower belt conveyor and/or is able to be transported over said belt conveyor. Preferably, the width of the lower belt conveyor is smaller by a multiple than the width of the items of laundry. For example, the width of the lower belt conveyor is smaller than a tenth of the width of large items of laundry and/or smaller than a tenth of the working width of the respective laundry treatment apparatus. This width thus corresponds to the width of the longitudinal strip of the item of laundry supported on the upper run of the lower belt conveyor.

If an upper belt conveyor is arranged above the lower belt conveyor, this upper belt conveyor preferably has the same width as the lower belt conveyor. With the presence of an upper belt conveyor, this is preferably configured to be shorter by being set back by at least the length of the placement region in the feed direction relative to the lower belt conveyor, so that the upper belt conveyor does not yet cover the placement region of the lower belt conveyor.

BRIEF DESCRIPTION OF THE DRAWINGS

Preferred exemplary embodiments the invention are described in more detail hereinafter with reference to the drawing. In the drawings.

DETAILED DESCRIPTION OF PREFERRED EMBODIMENTS

Figure 1:
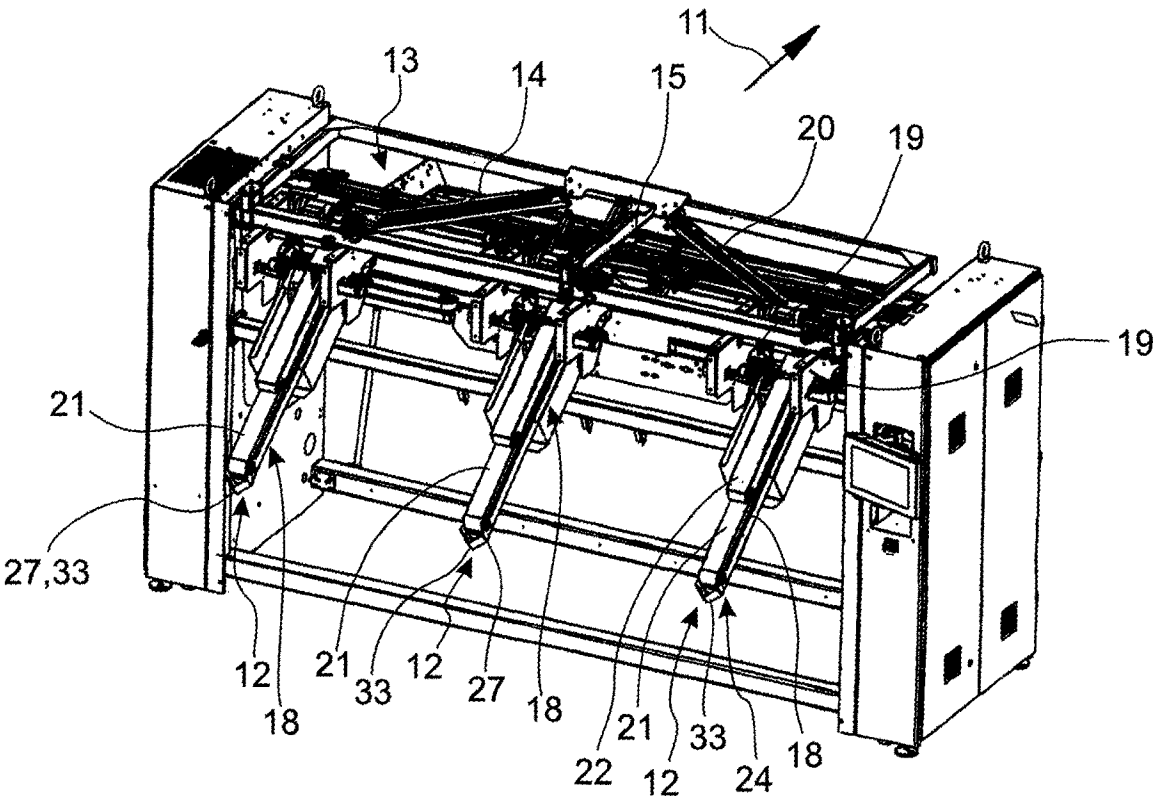
FIG. 1 shows a perspective view of a device (input machine) with three adjacently arranged loading stations.
Figure 2:
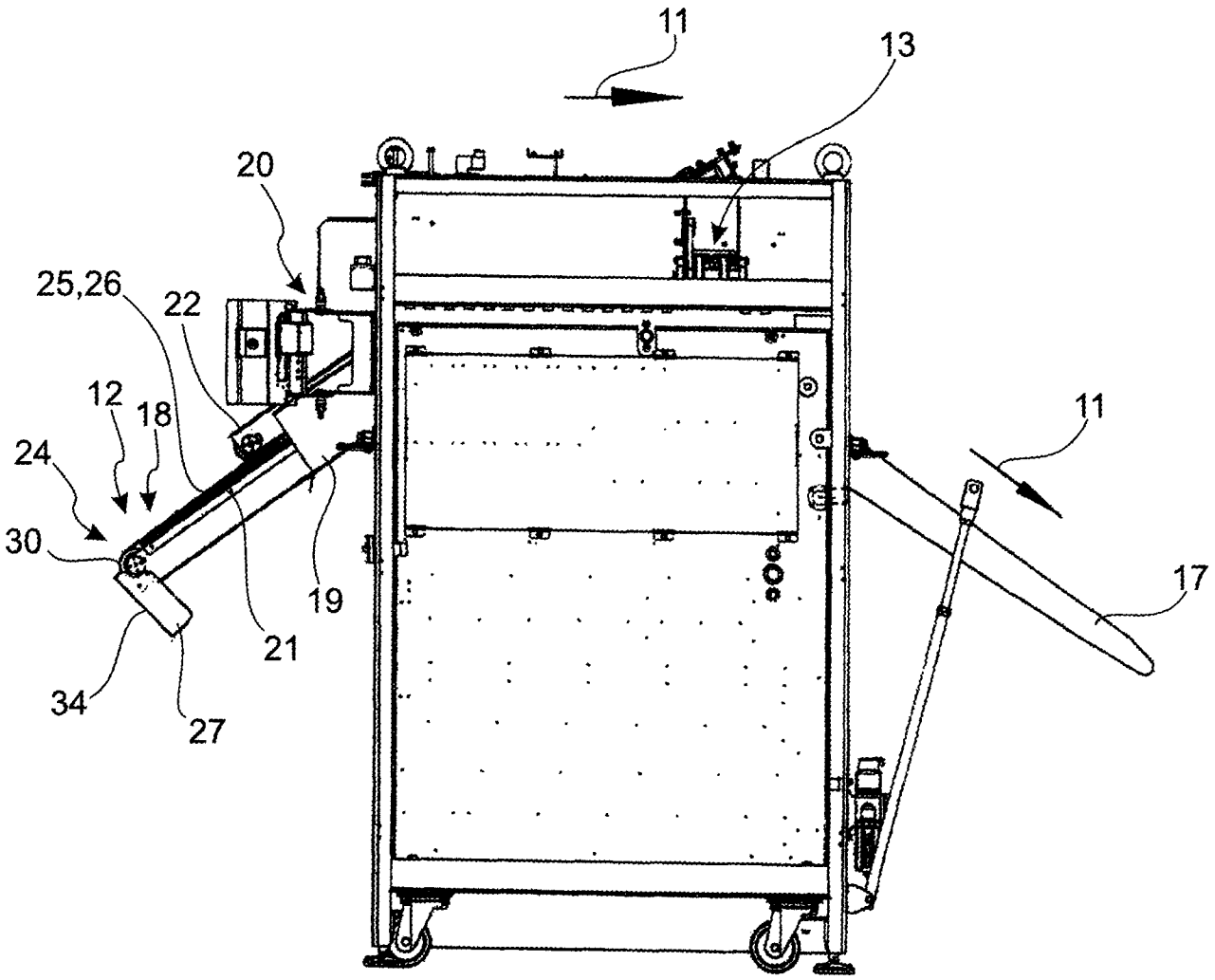
FIG. 2 shows a side view of the device of FIG. 1.
Figure 4:
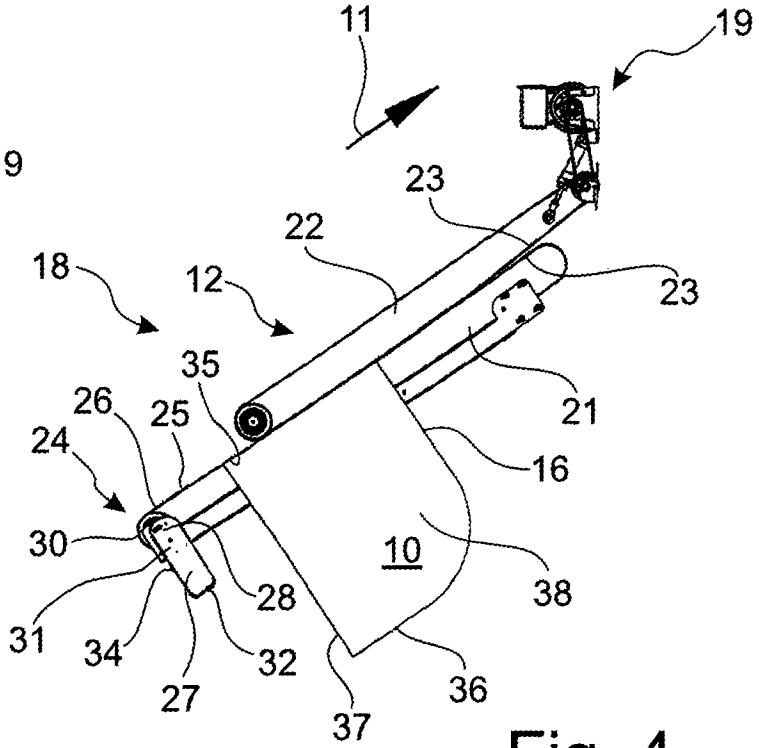
FIG. 4 shows a view of the loading station similar to FIG. 3 with the smoothing means located in an inactive position.

FIGS. 1 and 2 show a possible device for carrying out the method according to the invention. This device is a so-called input machine. This input machine serves to feed items of laundry 10, only shown schematically in some figures, and namely in particular flat items of laundry such as bed sheets, bed covers, pillow covers, towels, tablecloths or the like, in the feed direction 11 of a mangle, not shown in the figures. The device, however, may also serve to feed items of laundry to other laundry treatment apparatuses, for example folding machines.

The device or input machine shown here has three loading stations 12 which are configured, in particular, identically. The three loading stations 12 are arranged adjacent to one another with the same spacing to one another in a row running transversely to the feed direction 11 on the front face of the device. The central loading station 12 is located, in the case of the three loading stations 12 shown here, in the center of the device or input machine. The two other loading stations 12 are arranged eccentrically on opposing sides of the central loading station 12. The invention is not limited to the three loading stations 12. It is also suitable for devices with a larger or smaller number of loading stations 12, including just one single loading station 12.

When viewed in the feed direction 11, a spreading apparatus 13 follows the loading station 12. The spreading apparatus 13 has at least two spreading clamps 14 forming a spreading clamp pair. The spreading clamps 14 are arranged on carriages which may be moved toward one another and apart on a horizontal rail 15 running transversely to the feed direction 11. In the device shown, the spreading apparatus 13 has two spreading clamp pairs, with in each case two spreading clamps 14. It is also conceivable that the spreading apparatus 13 has just one spreading clamp pair or more than two spreading clamp pairs.

Each spreading clamp 14 serves for holding one of the adjacent corners of a front transverse edge 16 of the respective item of laundry 10. By moving apart the two spreading clamps 14 of the respective spreading clamp pair the front transverse edge 16 of the item of laundry 10 is stretched by the spreading apparatus 13 in order to spread out the item of laundry 10 below the spreading apparatus 13. Preferably, the two spreading clamps 14 of the respective spreading clamp pair are moved such that they center at least large items of laundry 10, which have to be mangled in a single track, relative to the center of the device.

When viewed in the feed direction 11, a feed conveyor 17 follows the spreading apparatus 13. The item of laundry 10 which has been spread out and centered by the spreading apparatus 13 is deposited with the leading, stretched-out front transverse edge 16 by the spreading clamps 14 of the respective spreading clamp pair on a front starting portion of the feed conveyor 17 with a front spread-out transverse edge region of the item of laundry 10 adjacent to the stretched-out front transverse edge 16.

Alternatively, it is conceivable to arrange a so-called depositing strip on the starting portion of the feed conveyor 17. Then the spread-out or stretched front transverse edge region of the item of laundry 10 is deposited by the respective spreading clamp pair onto the depositing strip, which then deposits this front transverse edge region onto the feed conveyor 17.

The device shown has just one feed conveyor 11. It is also conceivable that the device has a plurality of successive feed conveyors, wherein it is also conceivable that one feed conveyor located upstream of the mangle of another laundry treatment apparatus is formed form two superimposed partial conveyors.

The item of laundry 10 lying spread-out and/or stretched-out on the upper run of the feed conveyor is transported from the feed conveyor 17 to the mangle, not shown in the figures, or another laundry treatment apparatus and at the same time introduced into the mangle or the laundry treatment apparatus.

Each loading station 12 has a loading conveyor 18 which transports the item of laundry 10 in the feed direction 11. Two corner locators 19 are assigned or arranged downstream of the respective loading station 12. Each corner locator 19 serves for determining and for holding one of the adjacent corners or corner regions of a second, originally rear, transverse edge of the item of laundry 10.

In the device or input machine shown here, transfer clamps 20 are provided between the two corner locators 19 of each loading station 12 and the spreading apparatus 13. The transfer clamps 20 assigned to each loading station 12 are combined to form a transfer clamp pair. The transfer clamps 20 form thereby a double clamp respectively for one of the opposing corners of the transverse edge of the item of laundry.

The transfer clamp pair of each loading station 12 is able to be moved by a carriage on a rail. The rail of the central loading station 12 runs in a linear manner in the feed direction 11 along the center of the input machine and the feed conveyor 17. Starting from the outer loading stations 12, longer rails run obliquely upward in the direction of the spreading apparatus 13. These two rails are of identical length, but oriented differently, so that their rear ends are oriented toward the center of the input machine but terminate upstream of the center, when viewed in the feed direction 11. The relevant item of laundry 10 is able to be transferred onto the spreading clamps 14 of the spreading apparatus 13 by the respective transfer clamp pair.

Each of the loading conveyors 18 of the loading stations 12 which are configured identically has two narrow belt conveyors 21 and 22 of identical width, with in each case at least one endless conveyor belt 23 which is able to be driven in a revolving manner. The belt conveyors 21 and 22 are arranged one above the other in order to form a sandwich conveyor, wherein the runs of the conveyor belts 23 of the belt conveyors 21 and 22, which are oriented toward one another, overlap in some regions. The lower belt conveyor 21 is longer than the upper belt conveyor 22. These belt conveyors 21 and 22 of different lengths are arranged one above the other in a sandwich-like manner such that, when viewed in the feed direction 11, the upper belt conveyor 22 is located downstream of a front end 24 of the lower belt conveyor 21 in order to form an exposed front region of an upper run 25 of the lower belt conveyor 21. This exposed front region of the upper run 25 of the lower belt conveyor 21 forms a placement region 26 for one respective item of laundry 10.

In the exemplary embodiment of FIGS. 1 to 4 both belt conveyors 21 and 22 of each loading station 12 run in a linear manner and namely are oriented obliquely since they rise toward their rear end, i.e., in the direction of the corner locators 19. In the exemplary embodiment of FIGS. 5 to 8, a front portion of the lower belt conveyor 21 forming the placement region 26 is angled back relative to its following portion and namely such that the front portion with the placement region 26 runs horizontally or rises slightly, whilst the portion located therebehind of the lower belt conveyor 21, as in the exemplary embodiment of FIGS. 1 to 4, rises significantly or more sharply toward the corner locators 19. Located in this rising rear part of the lower belt conveyor 21 is the upper belt conveyor 22 which runs in a manner which rises obliquely in a linear manner and which thus overlaps with the rear part of the lower belt conveyor 21.

The drive of the two belt conveyors 21 and 22 may be implemented in different ways. For example, both belt conveyors 21 and 22 may be driven synchronously, but also just one of the belt conveyors 21 and 22 may be driven, wherein the other belt conveyor 21 or 22 is then entrained by being pulled along by the driven belt conveyor 21 or 22.

A smoothing means 27 is provided at the starting portion, namely a front end 24, of the lower belt conveyor 21 of each loading station 12. Preferably, the smoothing means 27 of all of the loading stations 12 are configured identically and arranged identically.

The respective smoothing means 27 is arranged or mounted in the region of the front end 24 upstream of the lower belt conveyor 21. In the exemplary embodiment shown, the respective smoothing means 27 is arranged so as to be pivotable with the front end 24 or in the region of the front end of the lower belt conveyor 21. Alternatively, the respective smoothing means 27 may be also displaceably arranged in the region of the front end 24 of the lower belt conveyor 21.

In the exemplary embodiment shown in the figures, the smoothing means 27 of each loading station 12 is pivotably arranged and/or mounted upstream of the lower belt conveyor 21 such that the smoothing means 27 is pivotable about a horizontal pivot axis 28 running transversely to the feed direction 11, and namely by a suitable actuating means, for example a pneumatic cylinder, not shown in the figures. The pivot axis 28 is located adjacent to and/or below an axis of rotation 29 of an optionally driven deflection roller 30 at the front end 24 of the lower belt conveyor 21. Alternatively, the pivot axis 28 of the smoothing means 27 may also be located on the axis of rotation 29 of the deflection roller 30. The smoothing means 27 is not then pivotable about the pivot axis 28 but pivotable about the axis of rotation 29 on a concentric path.

The respective smoothing means 27 is pivotable via the actuating means or the drive about the pivot axis 28 from an inactive position into an active position and back again. The inactive position is shown in FIGS. 2, 4, 5, and 6. FIGS. 1, 3, 7, and 8 show the active position of the smoothing means 27. In the exemplary embodiment shown, the respective smoothing means 27 is pivotable by approximately 90° in order to bring it from the inactive position into the active position and vice-versa. In this case, the smoothing means 27 carries out a quarter circle movement about the pivot axis 28. It is also conceivable that the pivot angle is slightly larger, for example up to 110°, preferably up to 100°. Optionally the pivot angle may also be less than 90°, by being at least 80°.

Figure 3:
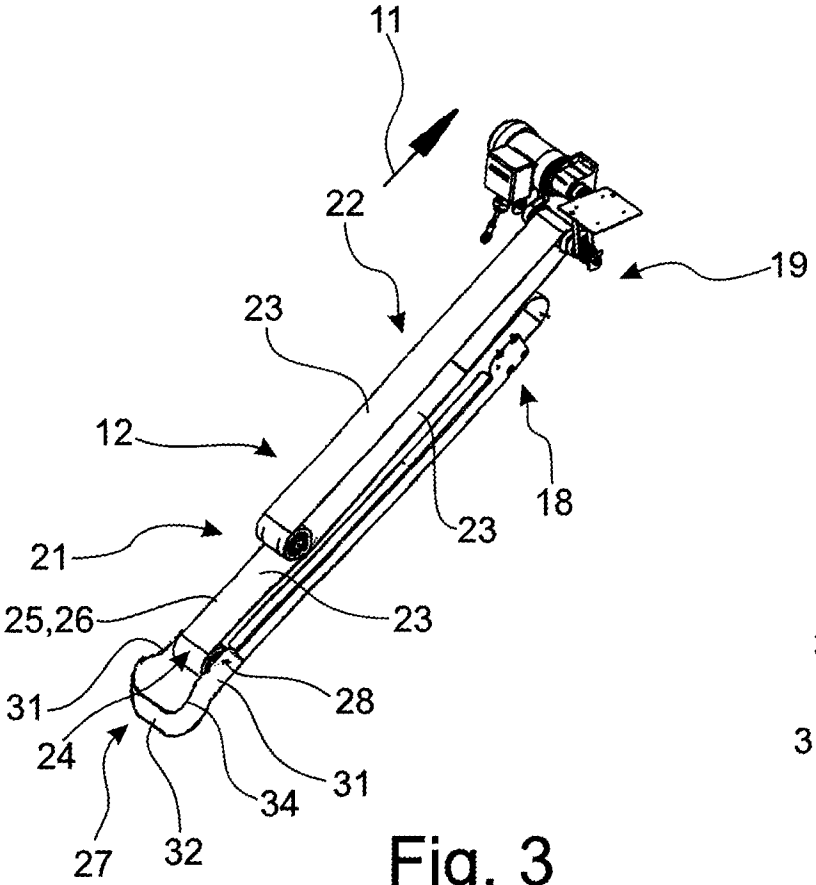
FIG. 3 shows a perspective view of a loading station with a smoothing means in an active position.
Figure 5:
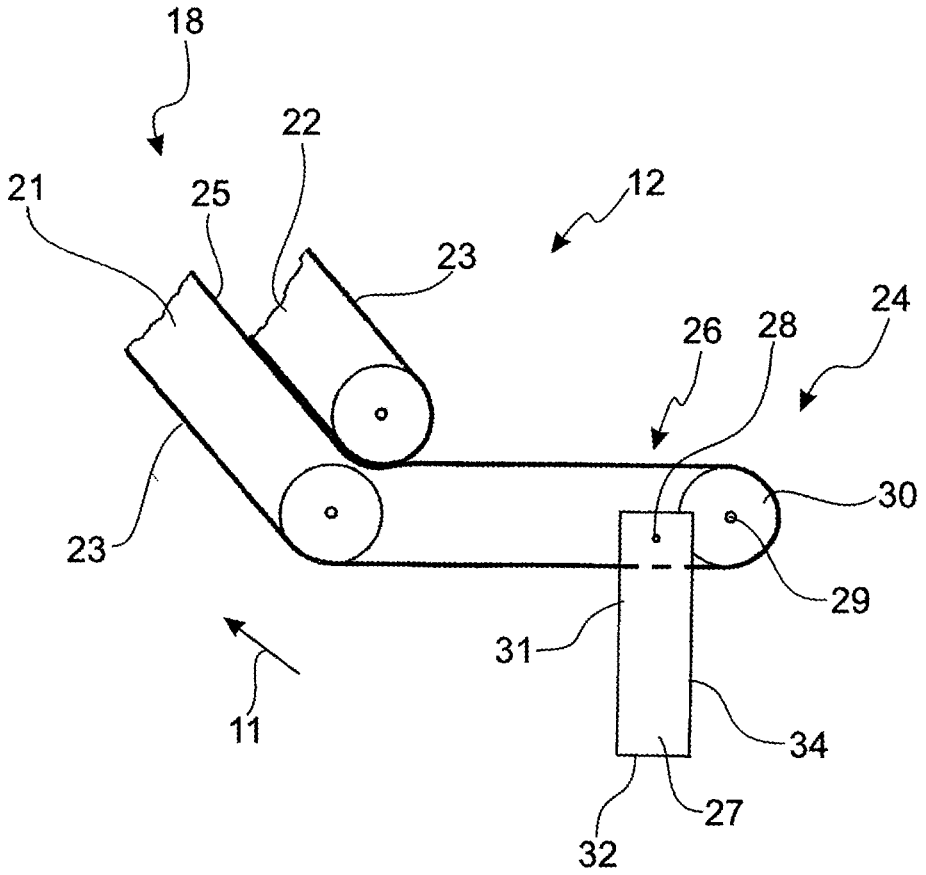
FIG. 5 shows a side view of an initial part of a loading station with the smoothing means located in the inactive position.
Figure 8:
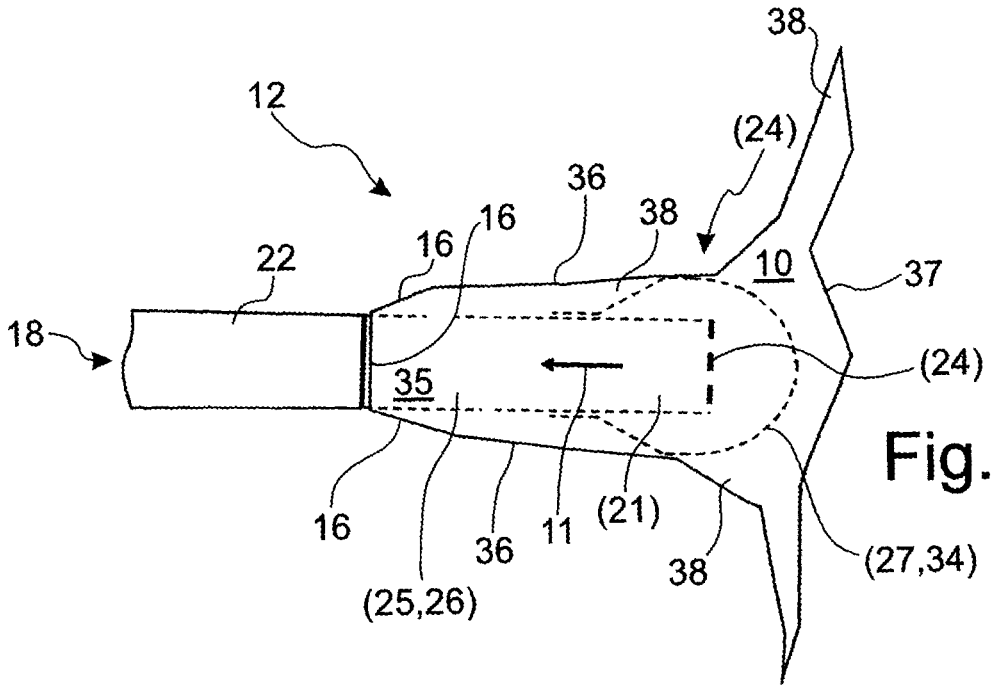
FIG. 8 shows a plan view of the view of FIG. 7.

The smoothing means 27 of each loading station 12 shown in the figures is configured in a C-shaped, for example U-shaped (FIGS. 1 and 2) or omega-shaped or horseshoe-shaped, manner (FIGS. 3 and 8). Such C-shaped smoothing means 27 may be formed in a simple manner from a metal strip and have two parallel limbs 31 which are preferably of identical length and a web 32 connecting these limbs together. The parallel limbs 31 have a clear spacing which corresponds to the outer faces of the opposing outer faces of the narrow lower belt conveyor 21. The respective smoothing means 27 is pivotably mounted on the pivot axis 28 with the end regions of the limbs 31. Preferably, the pivot axis 28 is located on or in a support frame of the lower belt conveyor 21.

In the exemplary embodiment of FIG. 1, the web 32 connecting the limbs 31 is angled back in a V-shaped manner to form a central tip 33 which is preferably slightly rounded. The web 32 in this case corresponds to the spacing of the limbs 31. FIGS. 3 and 8 show the smoothing means 27 with an arcuate web 32 which widens on either side starting from the limbs 31, so that a front region of the smoothing means 27 (which forms the web 32) has a slightly larger width than the lower belt conveyor 21.

The smoothing means 27 configured according to FIGS. 1, 3 and 8 are located in their inactive positions with the web 32 and optionally the front portions of the limbs 31 upstream of the front end 24 and the deflection roller 30 of the lower belt conveyor 21. In the exemplary embodiment shown, an upper edge 34 of the respective smoothing means 27 is located slightly below the lower run 25 and the placement region 26 of the lower belt conveyor 21. In the figures, this edge 34 runs approximately through the axis of rotation 29 of the deflection roller 30. It is also conceivable to arrange the smoothing means 27 upstream of the lower belt conveyor 21 such that the upper edge 34 is located between the axis of rotation 29 of the deflection roller 30 and the upper run 25 or the placement region 26, or is even located in the plane of the upper run 25 or the placement region 26 of the lower belt conveyor 21.

In the exemplary embodiment shown, the upper edge 34 of the smoothing means 27 runs approximately parallel to the placement region 26 or upper run 25 of the lower belt conveyor 21. Alternatively, however, it may also run slightly obliquely and namely rising slightly in the feed direction 11.

Figure 6:
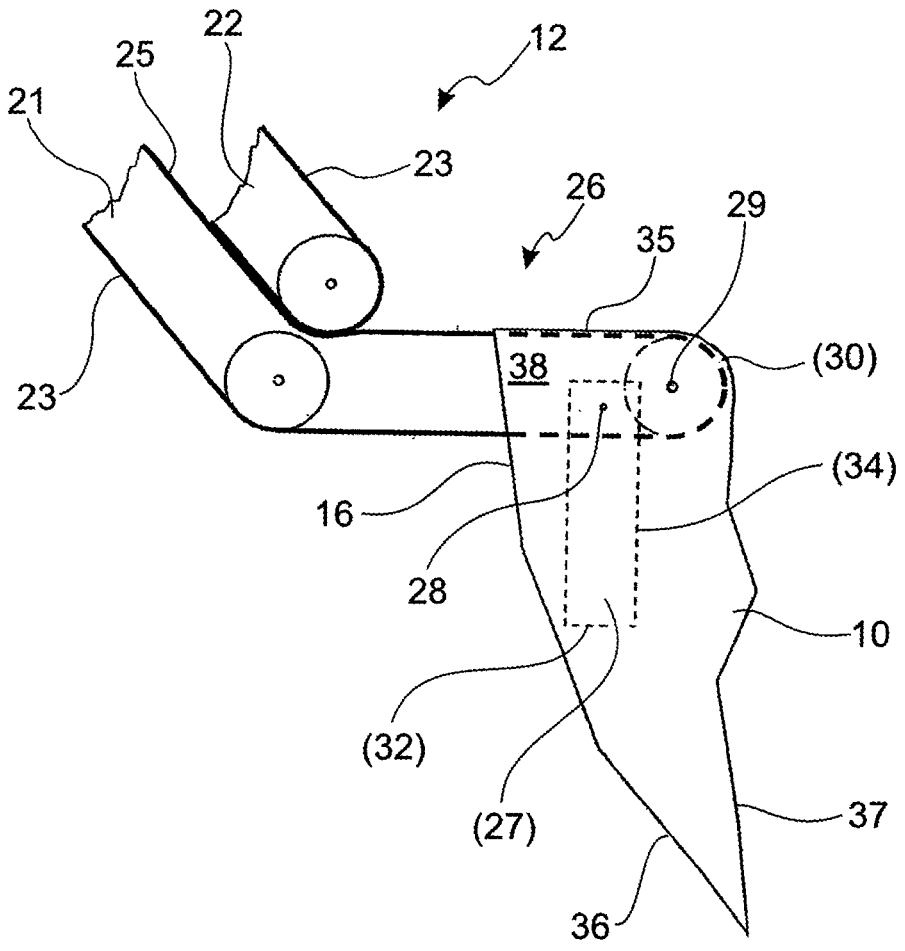
FIG. 6 shows a view similar to FIG. 5 with an item of laundry.

In the inactive position, the respective smoothing means 27 is pivoted below the front end 24 of the lower belt conveyor 21 (FIGS. 2, 4, 5 and 6). In this case the smoothing means 27 opposite the front end 24 of the lower belt conveyor 21 is slightly offset, i.e., set back, in the feed direction 11 (FIGS. 2 and 6). As a result, it is ensured that in the inactive position of the respective smoothing means 27 at least the part of the item of laundry 10 located upstream of the front end 24 of the lower belt conveyor 21 does not touch the smoothing means 27, in particular the edge 34 thereof.

The method according to the invention is described hereinafter with reference to the above-described device (input machine):

One respective item of laundry 10 is placed automatically, or by an operator, with a front part onto the placement region 26, in particular the exposed upper part of the upper run 25 on the lower belt conveyor 21. In this case, the smoothing means 27 is located in the inactive position, in particular below a front end region of the lower belt conveyor 21.

Only a starting portion of the longitudinal strip 35 of the item of laundry 10, starting from the front transverse edge 16 running transversely to the feed direction 11, is placed on the placement region 26 of the lower belt conveyor 21. The longitudinal strip 35 has a width which approximately corresponds to the width of the loading conveyor 18, in particular its lower belt conveyor 21. The longitudinal strip 35 is located between the opposing longitudinal edges 36 of the item of laundry 10. These longitudinal edges 36 run in the feed direction 11. At the end of the item of laundry 10 is located a rear transverse edge 37 thereof. Preferably, the longitudinal strip 35 extending in the feed direction 11 is located centrally or at least approximately centrally between the longitudinal edges 36 on opposing sides of the item of laundry 10. This results in a U-shaped configuration of the item of laundry 10 after a front part of the longitudinal strip 35 has been placed on the placement region 26. In this case, the outer edge portions 38 of the item of laundry 10 hang down on opposing sides from the narrow belt conveyor 21. Due to the narrow lower belt conveyor 21 which preferably only corresponds to approximately a tenth, up to a twentieth, of the width of large items of laundry 10, the longitudinal strip 35 between the longitudinal edges 36 also has a relatively small width so that with large items of laundry 10 relatively large edge portions 38 hang down in any case on opposing sides from the lower belt conveyor 21 (FIGS. 6 to 8).

The loading conveyor 18 of each loading station 12 is either continuously driven or already driven when the front part of the longitudinal strip 35 of the item of laundry 10 has been placed on the placement region 26, or it is driven only after the front part of the longitudinal strip 35 has been placed on the placement region 26. When the loading conveyor 18 is driven, the upper run 25 of the conveyor belt 23 of the lower belt conveyor 21 and also an upper run of the belt 23 of the upper belt conveyor 22 move synchronously in the feed direction 11.

After the placement of the front part of the longitudinal strip 35 of the item of laundry 10 onto the placement region 26 of the lower belt conveyor 21, a large part of the item of laundry 10 is still located upstream of the front end 24 of the lower belt conveyor 21. Primarily with large items of laundry 10, this may lead to the frictional force between the upper run 25 of the lower belt conveyor 21 in the placement region 26 and the part of the item of laundry 10 located thereon, and namely the starting portion of the longitudinal strip 35 which starts from the front transverse edge 16, being insufficient in order to transport the item of laundry 10 in the feed direction 11 and at the same time to pull the item of laundry 10 further onto the upper run 25 of the lower belt conveyor 21. Then a slippage occurs between the item of laundry 10 and the upper run 25. This slippage may lead to the front part of the item of laundry 10 slipping down from the upper run 25 of the placement region 26. In order to avoid such a slippage or the item of laundry 10 possibly slipping down from the front end 24 of the lower belt conveyor 21, when the front part of the longitudinal strip 35 is placed onto the placement region 26 and when the item of laundry 10 is initially pulled onto the lower belt conveyor 21, the smoothing means 27 is in the inactive position below the front end 24 of the lower belt conveyor 21 (FIG. 6). As a result, the smoothing means 27 does not impede the item of laundry 10 being initially pulled onto the lower belt conveyor 21, since a rear part of the longitudinal strip 35 located upstream of the front end 24 of the lower belt conveyor 21 has not yet been positioned or is not yet supported on the smoothing means 27, and as a result the initial pulling of the item of laundry 10, in particular the longitudinal strip 35 thereof, onto the lower belt conveyor 21 is not impeded or even prevented.

Figure 7:
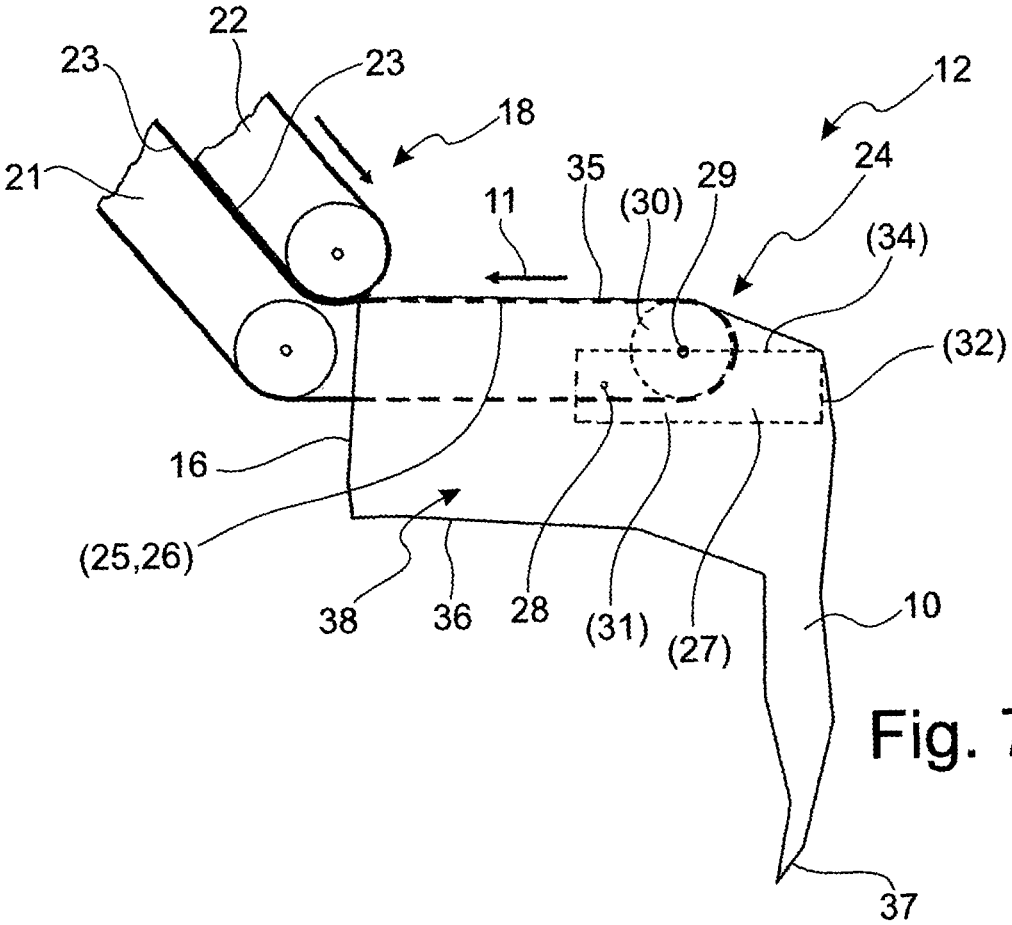
FIG. 7 shows a view similar to FIG. 6 with the smoothing means located in the active position and the initially pulled-out item of laundry.

Only when the item of laundry 10 is pulled sufficiently far onto the lower belt conveyor 21, in particular a part of the longitudinal strip 35 extending beyond the placement region 26 is pulled by a frictional contact on the upper run 25 of the lower belt conveyor 21, is the respective smoothing means 27 pivoted up into the active position (FIGS. 7 and 8). In this case, the smoothing means 27 performs approximately or at least a quarter circle rotation about the axis of rotation 29. The smoothing means 27 thus passes upstream of the front end 24 of the lower belt conveyor 21, wherein the longitudinal strip 35 is supported at least on a front part of the upper edge 34 of the C-shaped smoothing means 27. When the item of laundry 10 is pulled further onto the lower belt conveyor 21, the item of laundry then slides with the longitudinal strip 35 from the edge 34 of the C-shaped smoothing means 27 and with opposing edge portions 38 along the lateral surfaces of the C-shaped smoothing means 27. As a result, the longitudinal strip 35 is stretched transversely to the feed direction 11 and the opposing edge portions 38 are diverted on the lateral surfaces of the C-shaped smoothing means 27 running in the feed direction 11 or approximately in the feed direction 11. In this case, the part of the item of laundry 10 hanging down and still located upstream of the front end 24 and/or the smoothing means 27 is guided on either side adjacent to the lower belt conveyor 21 and at the same time smoothed and possibly straightened out.

Preferably, it is provided that the smoothing means 27 is brought into its active position as soon as the starting portion of the longitudinal strip 35, namely the inner or central portion of the front transverse edge 16 of the item of laundry 10 extending over the longitudinal strip 35, has entered a starting portion of a gap between the runs of the lower belt conveyor 21 and the upper belt conveyor 22 oriented toward one another. Then the item of laundry 10 is pulled by the respective loading conveyor 18 with sufficient force into the gap and thereby continuously advanced in the feed direction 11, wherein the item of laundry 10 is pulled increasingly onto the lower belt conveyor 21. As a result, there is no longer the risk that the item of laundry 10, when pulled over the smoothing means 27 located in the active position, is not able to be transported further or even slips down again from the lower belt conveyor 21 counter to the feed direction 11.

After the rear transverse edge 37 of the respective item of laundry 10 has moved beyond the smoothing means 27 and/or the rear transverse edge 37 of the item of laundry 10 has passed the front end 34 of the lower belt conveyor 21, the smoothing means 27 is pivoted back again into the inactive position. The loading station 12 is then ready to accept a subsequent item of laundry 10.

LIST OF REFERENCE NUMERALS

10 Item of laundry
11 Feed direction
12 Loading station
13 Spreading apparatus
14 Spreading clamp
15 Rail
16 Front transverse edge
17 Feed conveyor
18 Loading conveyor
19 Corner locator
20 Transfer clamp

21 Lower belt conveyor
22 Upper belt conveyor
23 Conveyor belt
24 Front end
25 Upper run
26 Placement region
27 Smoothing means
28 Pivot axis
29 Axis of rotation
30 Deflection roller
31 Limb
32 Web
33 Tip
34 Edge
35 Longitudinal strip
36 Longitudinal edge
37 Rear transverse edge
38 Edge portion

What is claimed is:

1. A method for feeding items of laundry (10) to a mangle or another laundry treatment apparatus, comprising transferring one respective item of laundry (10) to a belt conveyor (21) of at least one loading station (12), transferring the item of laundry (10) from the at least one loading station (12) onto a spreading apparatus (13), from which the item of laundry (10) is spread out transversely to the feed direction (11) in which the item of laundry (10) is able to be fed to the laundry treatment apparatus, and feeding the spread-out item of laundry (10) at least by at least one feed conveyor (17) to the laundry treatment apparatus, wherein the spreading apparatus (13) is arranged downstream of the belt conveyor (21) of the loading station (12), wherein a smoothing means (37) for smoothing the item of laundry (10) is arranged upstream of the belt conveyor (21), wherein the smoothing means (27) is brought from an inactive position into an active position after the item of laundry (10) has been initially pulled onto the belt conveyor (21) in the feed direction (11), wherein in the active position the smoothing means (27) is supported below the item of laundry (10) for smoothing the part of the item of laundry (10), which is still located upstream of the belt conveyor (21), when pulled further onto the belt conveyor (21), and wherein the item of laundry (10) is pulled onto the belt conveyor (21) by driving the belt conveyor (21) with an upper run (25) of the belt conveyor (21) running in the feed direction (11).

2. The method as claimed in claim 1, wherein the respective item of laundry (10) is placed or deposited on a placement region (26) on the starting portion of the belt conveyor (21) when the smoothing means (27) is in the inactive position, wherein the item of laundry (10) does not yet slide along the smoothing means (27).

3. The method as claimed in claim 1, wherein when the smoothing means (27) is located in the inactive position the respective item of laundry (10) is placed or deposited onto the placement region (26) of the belt conveyor (21) with a starting portion of a longitudinal strip (35) between opposing longitudinal edges (36) running in the feed direction (11).

4. The method as claimed in claim 1, wherein the smoothing means (27) is pivoted from the active position into the inactive position and vice-versa.

5. The method as claimed in claim 4, wherein in the active position an upper edge (34) or an upper sliding surface of the smoothing means (27) is located upstream of the placement region (26) and in the inactive position of the smoothing means (27) this upper edge (34) or the upper sliding surface is located below the placement region (26) or a front end region of the belt conveyor (21).

6. The method as claimed in claim 3, wherein when the item of laundry (10) is pulled onto the belt conveyor (21), at least the longitudinal strip (35) of the item of laundry (10) is increasingly deposited on the upper run (25), whilst edge portions with the longitudinal edges (36) adjoining the longitudinal strip (35) on either side hang down on either side of the belt conveyor (21).

7. The method as claimed in claim 3, wherein after the item of laundry (10) has been deposited onto the placement region (26) of the belt conveyor (21), at least the longitudinal strip (35) is increasingly pulled by the driven belt conveyor (21) onto the upper run (25) of the belt conveyor (21).

8. The method as claimed in claim 3, wherein after the item of laundry (10) has been deposited onto the placement region (26) of the belt conveyor (21), at least the longitudinal strip (35) is increasingly pulled onto the upper run (25) of the belt conveyor (21) until a portion of the front transverse edge (16) of the item of laundry (10) which is located in the region of the longitudinal strip (35) is located in the region of an upper belt conveyor (22), which is arranged set back above the belt conveyor (21) in a sandwich-like manner, or after at least one part of the longitudinal strip (35) has been initially pulled onto the belt conveyor (21) the smoothing means (27) is transferred, preferably pivoted, into the active position for smoothing the rear part of the item of laundry which is still located upstream of the belt conveyor (21) and/or the smoothing means (27) thereof.

9. The method as claimed in claim 3, wherein after the item of laundry (10) has been deposited onto the placement region (26) of the belt conveyor (21), at least the longitudinal strip (35) is increasingly pulled onto the upper run (25) of the belt conveyor (21) and, after the at least one part of the longitudinal strip (35) has been initially pulled onto the belt conveyor (21), the smoothing means (27) is pivoted into the active position for smoothing the rear part of the item of laundry (10) which is still located upstream of the belt conveyor (21) and/or the smoothing means (27) thereof.

10. A device for feeding items of laundry to a mangle or another laundry treatment apparatus comprising:

at least one loading station (12) which has at least one belt conveyor (21) transporting one respective item of laundry (10) in the feed direction (11);

a smoothing means (27) arranged on a starting portion of the belt conveyor (21);

a spreading apparatus (13) arranged downstream in the feed direction (11) of the at least one loading station (12) for spreading out the item of laundry (10) transversely to the feed direction (11); and at least one feed conveyor (17) for feeding the spread-out item of laundry (10) to the laundry treatment apparatus, wherein the smoothing means (27) is pivotable at a front end (24) of the belt conveyor (21) of the respective loading station (12), when viewed in the feed direction (11), by driving about a horizontal pivot axis (28) running transversely to the feed direction (11), wherein the item of laundry (10) is pulled onto the belt conveyor (21) by driving the belt conveyor (21) with an upper run thereof running in the feed direction (11), wherein the smoothing means (27) of the at least one loading station (12) is able to be brought from an inactive position into an active position and vice-versa.

11. The device as claimed in claim 10, wherein the smoothing means (27) is pivotably arranged at a front end (24) of the belt conveyor (21) of the respective loading station (12), when viewed in the feed direction (11).

12. The device as claimed in claim 10, wherein the at least one smoothing means (27) is pivotable in the inactive position below the belt conveyor (21) and is pivotable in the active position upstream of the front end (24) of the belt conveyor (21).

13. The device as claimed in claim 10, wherein the or each smoothing means (27) is configured in a C-shaped or horseshoe-shaped manner, by being pivotably mounted on the pivot axis (28) with parallel limbs (31) on opposing sides of a stationary support frame of the respective belt conveyor (21).

14. The device as claimed in claim 13, wherein the smoothing means (27) which is configured in a C-shaped manner has a U-shaped, omega-shaped or horseshoe-shaped design and in the active position an upper edge (34), or also at least one part of its outer face, serves as a support surface, bearing surface or sliding surface for the item of laundry (10).

15. The device as claimed in claim 10, wherein the belt conveyor (21) has a width which is less than the width of the item of laundry (10) to be fed to the laundry treatment apparatus.

16. The device as claimed in claim 10, wherein the belt conveyor (21) has a width which corresponds to the width of the longitudinal strip (35) between opposing outer longitudinal edges (36) of the respective item of laundry (10).

* * * * *